United States Patent [19]

Hasegawa et al.

[11] Patent Number: 4,505,199

[45] Date of Patent: Mar. 19, 1985

[54] SYSTEM FOR RETAINING STENCIL PRINTING MASTER ON PRINTING DRUM BY CLAMP STRIP HINGED ALONG DRUM GENERATOR

[75] Inventors: Takanori Hasegawa; Takanobu Shimada, both of Tokyo, Japan

[73] Assignee: Riso Kagaku Corporation, Tokyo, Japan

[21] Appl. No.: 518,422

[22] Filed: Jul. 29, 1983

[30] Foreign Application Priority Data

Nov. 26, 1982 [JP] Japan ..... 57-207217

[51] Int. Cl.[3] ..... B85C 17/08

[52] U.S. Cl. ..... 101/127.1; 101/382 MV; 101/415.1

[58] Field of Search ..... 101/127.1, 128.1, 382 R, 101/382 MV, 383, 415.1; 51/362, 364; 271/DIG. 3; 402/503; 270/18

[56] References Cited

U.S. PATENT DOCUMENTS

| | | | |
|---|---|---|---|
| 786,633 | 4/1905 | Dick | 101/415.1 |
| 2,229,059 | 1/1941 | Ditty et al. | 101/415.1 |
| 2,231,291 | 2/1941 | Morrison | 101/382 MV |
| 2,237,734 | 4/1941 | Grimsted | 101/129 X |
| 2,730,948 | 1/1956 | Mitchell | 101/415.1 |
| 2,775,199 | 12/1956 | Claff et al. | 101/415.1 |
| 3,017,545 | 1/1962 | Meier | 101/382 MV |
| 3,745,626 | 7/1973 | Bray | 101/382 MV X |
| 3,941,054 | 3/1976 | Springer | 101/128.1 X |

FOREIGN PATENT DOCUMENTS

| | | | |
|---|---|---|---|
| 899942 | of 1949 | Fed. Rep. of Germany | 101/127.1 |
| 368103 | 11/1906 | France . | |
| 596749 | 10/1925 | France . | |
| 1383860 | 11/1964 | France . | |
| 317491 | 1/1957 | Sweden . | |
| 108479 | 4/1964 | Switzerland . | |
| 259931 | of 1927 | United Kingdom | 101/127.1 |

OTHER PUBLICATIONS

IBM Technical Disclosure Bulletin; vol. 19, No. 5; Oct. 1976.

Xerox Disclosure Journal; vol. 3, No. 2; Mar./Apr. 1978.

*Primary Examiner*—Edgar S. Burr
*Assistant Examiner*—John A. Weresh
*Attorney, Agent, or Firm*—Stevens, Davis, Miller & Mosher

[57] ABSTRACT

A magnet strip extends along one generator of a printing drum of a rotary stencil printing device. A clamp strip, made of a material which is magnetically attractable, is hinged to said printing drum along a line substantially parallel to said one generator thereof, near one side of said magnet strip, so that said clamp strip can be pivoted either so as to lie against and along said magnet strip, with a leading edge of a stencil master for stencil printing interposed therebetween so as to clamp the leading edge of the stencil master to the printing drum, or so as to be removed from said magnet strip so as to release the stencil master. Thereby the stencil master can be conveniently retained to the printing drum in a manner which is suitable for automation, and does not require any reinforced lug portion along the leading edge of the stencil master.

6 Claims, 2 Drawing Figures

SYSTEM FOR RETAINING STENCIL PRINTING MASTER ON PRINTING DRUM BY CLAMP STRIP HINGED ALONG DRUM GENERATOR

BACKGROUND OF THE INVENTION

The present invention relates to a device for selectively retaining a leading edge of a stencil printing master onto a printing drum of a rotary stencil printing device.

A certain type of rotary stencil printing device which incorporates a hollow printing drum around which a printing stencil master is wrapped is becoming widely used. In such a stencil printing device, printing ink is supplied from within the drum through perforations which extend from its inside space to its outer surface to the radially inner surface of the stencil master wrapped around the drum, and some of this ink passes through multiple perforations in certain previously perforated parts of the stencil master to the radially outward surface of the stencil master, whence this ink is then able to be transferred to the surface of a sheet of printing paper pressed against said outer surface of the stencil master, as the printing drum with the stencil master wrapped around it is rotated.

In such a rotary stencil printing device, a means is required to be provided for retaining a leading edge of the stencil master along an outer surface portion of the printing drum and parallel with with the central axis thereof (hereinafter called "peripheral line" for the sake of convenience), so that the stencil master is wrapped around the printing drum with a proper tension being applied thereto and the stencil sheet adhered around the printing drum by a viscous ink does not shift relative to the printing drum during the rotary stencil printing process.

For use with currently manufactured conventional stencil printing devices, the leading edge of the stencil master is formed with a reinforced lug portion, made for example of cardboard, and this lug portion is formed with a plurality of perforated engaging holes therein, and along the peripheral line of the printing drum there are provided a number of engagement projections corresponding to these engaging holes, the cardboard lug portion thus being retained against the printing drum along said peripheral line with the engagement projections engaged into the engaging holes. A clamp strip is generally provided to mechanically press the cardboard lug portion mechanically to the printing drum along said peripheral line, or such a clamp strip may be omitted whne the engagement between the holes and the projections is formed to be of a non-return type.

These conventional constructions for clamping the leading edge of the stencil master to the printing drum operate generally satisfactorily. However, there is still required a delicate and tedious hand job of properly aligning the lug portion of the stencil master against the peripheral line of the printing drum in a proper position for the engagment projections to be properly engaged into the engaging holes, and this fatally obstructs automation of the process of mounting and demounting of a stencil master to a printing drum. Further, because the stencil master, with this form of stencil retaining system, is required to have the above mentioned reinforcing lug provided along its leading edge, it is not possible to utilize continous stencil master which is cut off from a roll of stencil master as and when required, but instead the stencil master sheets must be individually manufactured in advance with reinforcing lugs thereon, which is expensive. The use of a headless stencil master, which is typically a piece of plastic material of the thickness of a few tens of microns, without any particular construction for the leading edge thereof, is a very desirable object for implementation in a stencil printing device, and accordingly the prior art schemes for retaining a leading edge of a stencil master onto a printing drum of a rotary stencil printing device are seriously deficient.

SUMMARY OF THE INVENTION

Accordingly, it is the primary object of the present invention to provide a system for retaining a leading edge of a stencil master to a printing drum, which is well adapted to the use of headless stencil masters which have no reinforced lug edge portions.

It is a further object of the present invention to provide such a system for retaining a leading edge of stencil master to a printing drum, which is well adapted to a rotary stencil printing device in which the stencil masters are cut off from a roll of stencil master as and when required.

It is a further object of the present invention to provide such a system for retaining a leading edge of a stencil master to a printing drum, which does not require any delicate alignment process for the stencil master.

It is a further object of the present invention to provide such a system for retaining a leading edge of a stencil master to a printing drum, which is well adapted to use in an automatic rotary stencil printing device in which the stencil masters are mounted and demounted automatically.

It is a yet further object of the present invention to provide such a system for retaining a leading edge of a stencil master to a printing drum, which is easily operated.

It is a yet further object of the present invention to provide such a system for retaining a leading edge of a stencil master to a printing drum, which is reliable.

It is a yet further object of the present invention to provide such a system for retaining a leading edge of a stencil master to a printing drum, which is relatively cheap in its construction.

It is a yet further object of the present invention to provide such a system for retaining a leading edge of a stencil master to a printing drum, which is relatively cheap in its operation because it is adapted to be employed using a relatively cheap type of stencil master.

According to the most general aspect of the present invention, these and other objects are accomplished by a system for retaining a leading edge of a a stencil master to a cylindrical rotatably mounted printing drum of a stencil printing device, comprising: a magnet strip provided in said printing drum to extend substantially along one generator thereof; and a clamp strip made of a material which is magnetically attracted by said magnet strip so as to be held thereon by an attracting magnetic force but removable from said magnet strip against the attracting magnetic force. one edge of said clamp strip being hinged to said printing drum along a line substantially parallel to said one peripheral line thereof, near one side of said magnet strip, so that said clamp strip can be pivoted either so as to lie against and along said magnet strip or so as to be removed from said magnet strip; whereby said clamp strip when in a position as lying against and along said magnet strip retains said leading edge of said stencil master as interposed between said clamp strip and said magnet strip.

According to such an apparatus, when the clamp strip is thus hinged so as to be positioned against the magnet strip with the leading edge of the stencil master in the direction of rotation of the printing drum during stencil printing in between them, the clamp strip is magnetically attracted towards the magnet strip and clamps said leading edge of the stencil master against the printing drum along said generator thereof securely. Then, by a self wrapping effect of the sort well known, the entire stencil master is held against the printing drum as it revolves for stencil printing. According to this construction, it is actually advantageous for the leading edge of the stencil master to be as thin as possible, so that this apparatus is well adapted to clamp a stencil master whose leading edge is made from the same thin plastic material as the rest of the stencil master, and is well adapted to the use of headless stencil masters which have no reinforced lug edge portions, for instance ones which are cut off from a roll of stencil master as and when required. Also, as this apparatus does not require any delicate alignment process for the stencil master, it is well adapted to use in an automatic rotary stencil printing device in which the stencil masters are mounted and demounted automatically. The apparatus itself is of a relatively cheap construction, and further is cheap during use, as it can use continuous sheet type stencil master, which is much cheaper than stencil masters which have special reinforced lug leading edge portions. Further, an additional advantage is obtained, in that if the clamp strip is so pivoted as to form an acute angle with the portion of the printing drum surface on which the magnet strip is provided, then the leading edge of the stencil master may be fed into this acute angle, which is convenient for locating this leading edge of the stencil master accurately.

Further, according to a more particular aspect of the present invention, the magnet strip may be made of rubberized magnet material. In this case, the risk of damage to the stencil master during securing of it and the risk of the leading edge of the stencil master becoming escaped from the clamping during stencil printing are both reduced, since such rubberized magnet material is relatively soft and also provides an increased friction coefficient.

Further, according to another more particular aspect of the present invention, these and other objects are more particularly and concretely accomplished by a system for retaining a leading edge of a stencil master of the type described above, further comprising a permanent magnet mounted at a part of the surface of said printing drum on the other side of said hinging line of said clamp strip from said magnet strip.

According to such an apparatus, when said clamp strip is hinged away from said magnet strip so as to release the leading edge of the stencil master, then it may be hinged right over through an angle of approximately 180°, so as to be attracted by said permanent magnet and so as to be thereby securely held in place. This is very helpful for ensuring that said clamp strip does not accidentally become pivoted against said magnet strip, during the process of removal of a used stencil master, which usually involves rotation of the printing drum with the leading edge of the used stencil master being thus released.

Further, according to another more particular aspect of the present invention, these and other objects are more particularly and concretely accomplished by a system for retaining a leading edge of a stencil master of the type first described above further comprising a means for rotating said clamp strip about its said hinging line mechanically; and optionally this means for rotating said clamp strip about its said hinging line mechanically may comprise a first gear wheel fixedly rotationally coupled to said clamp strip and a second gear wheel which can be selectively engaged with or disengaged from said first gear wheel and which can be selectively rotationally powered in either rotational direction.

According to such an apparatus, this means for mechanically rotating the clamp strip may be used either to rotate said clamp strip towards said magnet strip so as to clamp the leading edge of a stencil master which is to be used for stencil printing as explained above, or to rotate said clamp strip away from said magnet strip so as to release said leading edge of said stencil master when the stencil printing therefrom has been completed, so as to dispose of said used stencil master. This particular construction is very suitable for use in an automatic type of stencil printing device in which the stencils are charged and discharged automatically.

Further, according to a yet more particular aspect of the present invention, these and other objects are more particularly and concretely accomplished by such a system for retaining a leading edge of a stencil master as first described above, further comprising a means for mechanically preventing the rotation of said printing drum during rotation of said clamp strip about its said hinging line, which may comprise a bracket with a slot formed therein which can selectively be moved towards or away from the axis of said printing drum, said slot, when said bracket is thus moved towards said axis of said printing drum, engaging over some member fixed to said printing drum. This construction is very helpful for ensuring that said printing drum does not rotate about its axis, during the process of rotating the clamp strip about its axis to secure or to release the leading edge of a stencil master as explaind above. In the case that the construction described above employing a first and a second gear wheel for mechanically rotating the clamp strip is utilized, then this second gear wheel may be optionally coupled in its transverse motion to said bracket while of course being rotatable with respect thereto, so that said second gear wheel comes to be engaged with said first gear wheel as said bracket is moved towards the axis of said printing drum, and comes to be disengaged from said first gear wheel as said bracket is moved away from the axis of said printing drum. Thus, in this case, this motion of the bracket is advantageously used for two separate purposes.

BRIEF DESCRIPTION OF THE DRAWINGS

The present invention will now be shown and described with reference to a preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols ih the various figures thereof, and:

DESCRIPTION OF THE PREFERRED EMBODIMENT

Figure 1:
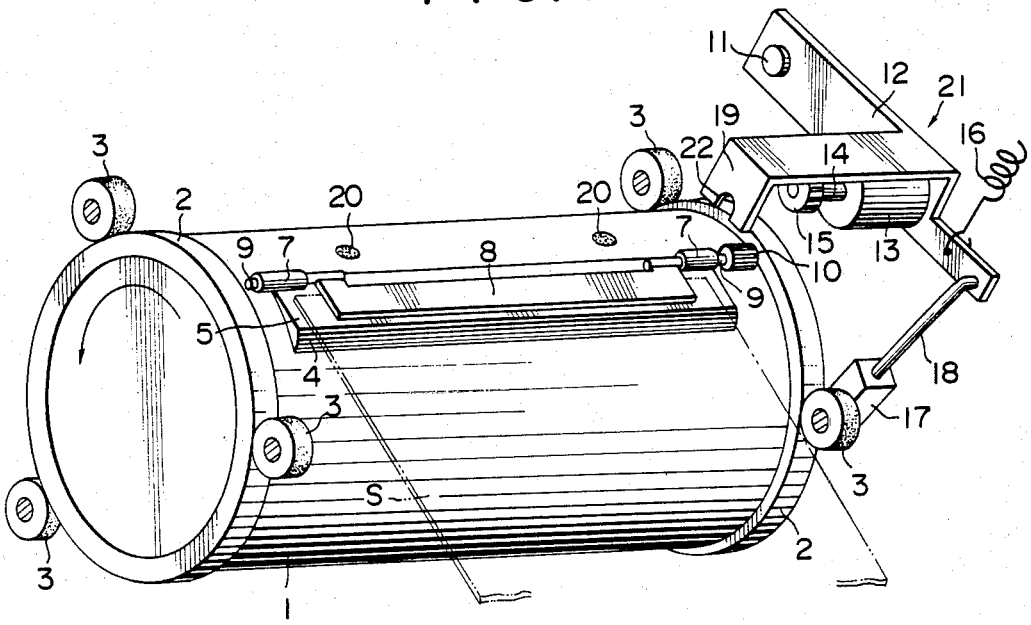
FIG. 1 is a perspective view, showing a printing drum of a rotary stencil printing device with a stencil master wrapped around it, the leading edge of said stencil master being secured along a peripheral line of the drum by the preferred embodiment of the system for retaining a stencil master to a printing drum according to the present invention.

The present invention will now be described with reference to the preferred embodiment thereof. FIG. 1 shows in perspective view a printing drum 1 of a rotary stencil printing device of the type described earlier, having a perforated wall, with the leading edge of a stencil master S secured to it. The printing drum 1 is rotatably mounted by guide surfaces 2 formed on its axially extreme circumferential portions, which are each supported by a plurality of rollers 3, so as to be able to turn around its axis, and the leading edge of the stencil master S is retained and fixed along a generator of the printing drum 1 by a preferred embodiment of the system for retaining a leading edge of a stencil master to a printing drum according to the present invention. The rollers 3 are themselves supported by a framework not shown in the Figures. The printing drum 1 has a preferred direction of rotation while the apparatus is being used for printing as indicated by the arrows in FIGS. 1 and 2, and, by this mere fixing of the leading edge of the stencil master S to the printing drum 1 without any other part of the stencil master S being fixed, said stencil master S is kept securely wrapped around the drum, by a self wrapping effect supported by the adhesive effect of viscous printing ink supplied from the inside of the printing drum 1 through the perforations formed in its wall.

A stage portion 5 is provided on the outer surface of the printing drum 1, extending approximately along said one of the generators thereof, and in a groove, not shown, formed in the flat outer surface of this stage portion 5 there is embedded a permanent magnet strip 6, so that the outer surface 6*a* of the magnet strip 6 is substantially flush with the outer surface of the stage portion 5, extending substantially along said peripheral line of the printing drum 1. It is desirable that the permanent magnet strip 6 should be made of multipole magnet rubber strip of a per se well known sort, so that the outer surface 6*a* thereof is soft and provides a high frictional coefficient, and so that the attractive magnetic force exerted by the magnet strip 6 should be effected in a uniform distribution over the whole length of the magnet strip 6.

Figure 2:
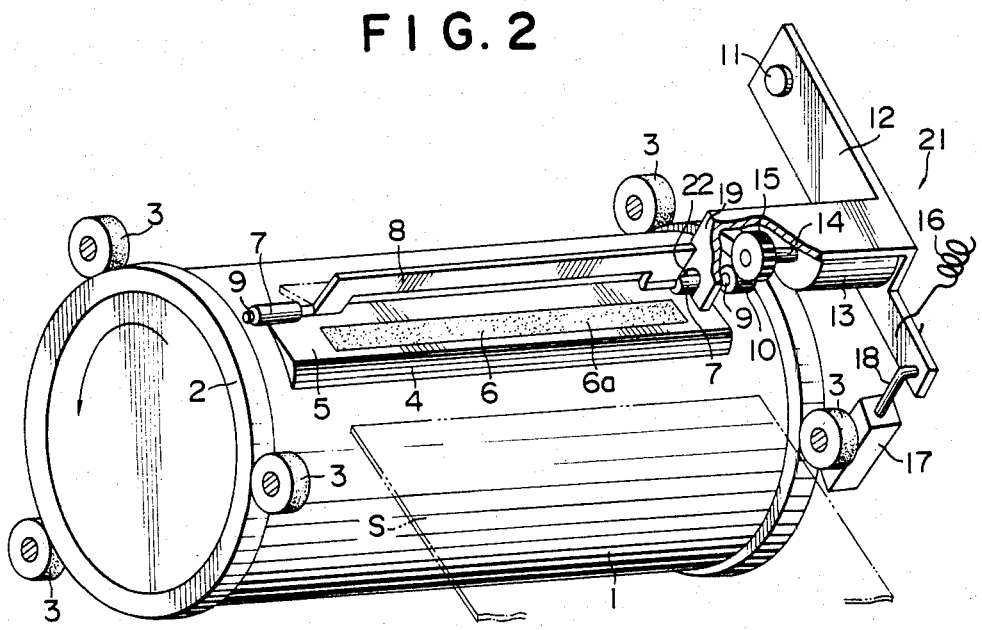
FIG. 2 is a perspective view, similar to FIG. 1, showing said printing drum of said rotary stencil printing device with said stencil master being released from said peripheral line of the drum by the preferred embodiment of the the present invention.

Further, two bearing brackets or hinges 7 are provided, one at each of the ends of the stage portion 5, and each of these brackets 7 pivotally supports one of two pivots 9, which are provided on the opposite ends of a clamp strip 8 which is shaped as an elongated rectangle; in more detail, the pivots 9 are mounted to the clamp strip 8 at opposite ends of one of the long sides thereof, extending in the same line as said long side. Thus the clamp strip 8 is provided as extending generally along the magnet strip 6 with its one long side pivoted to the drum 1 by the pivots 9 and the hinges 7, and thus extending along said peripheral line of the printing drum 1. The clamp strip 8 is made of a stiff magnetically susceptible material which is attracted by a magnetic field, such as for example stainless steel strip, and by the pivoting of the pivots 9 and the hinges 7 the clamp strip 8 can be moved between two extreme positions: a first extreme position shown in FIG. 1, in which said clamp strip 8 is laid against the permanent magnet strip 6 with the interposition of the leading edge of the stencil sheet S therebetween, in which first extreme position said clamp strip 8 is attracted by the permanent magnet strip 6 with considerable force so that they clamp the leading edge of the stencil sheet S between them, and a second extreme position shown in FIG. 2 by the phantom lines, in which said clamp strip 8 is pivoted through an angle of approximately 180° from said first extreme position, and is laid against the printing drum 1 away from said permanent magnet strip 6 and away from said leading edge of said stencil sheet S, in which second position said clamp strip 8 and said permanent magnet strip 6 release said leading edge of the stencil sheet S, as indicated in FIG. 2. The position of said clamp strip 8 shown by the solid lines in FIG. 2 is an intermediate position between the above described first and second extreme positions thereof. When the clamp strip 8 is in its above described second extreme position, in which it is pivoted away from the leading edge of the stencil sheet S and away from the permanent magnet strip 6, it is pulled against and held by a pair of permanent magnets 20 embedded in the outer surface of the printing drum 1, which thus retain said clamp strip 8 in this second extreme position thereof. On the outside end of one of the pivots 9 there is fixedly mounted a gear wheel 10, for driving this rotation of the clamp strip 8 as will hereinafter be explained.

Generally above the printing drum 1 from the point of view of FIGS. 1 and 2, there is provided a driving unit for moving the clamp strip 8 between its two said extreme positions described above, generally denoted by the reference numeral 21. To a support frame not shown in the drawings there is pivoted by a pivot 11 one end of a lever 12, to which there is fitted an electric motor 13. This electric motor 13 has a power output shaft 14 which extends in the horizontal direction from the point of view of the figures, parallel to said peripheral line of the printing drum 1 and to the hinges 7 and the pivots 9, on which a drive gear 15 is fixedly mounted, opposing the gear wheel 10 on the pivot 9 in the transverse direction to their axes. The electric motor 13 is controlled as will hereinafter be explained.

The lever 12 and the electric motor 13 mounted thereon, etc., can be rotated by pivoting around the pivot 11 either to a first position shown in FIG. 1, in which, irrespective of the rotary position of the printing drum 1, the drive gear wheel 15 is disengaged from the gear wheel 10 and thus the electric motor 13 is drivingly disconnected from the clamp strip 8 and cannot rotate it, or to a second position shown in FIG. 2, in which, provided that the printing drum 1, with the clamp strip 8 mounted thereto are in their rotary position as shown in the figures in which the axis of the pivots 9 and the pivoted edge of the clamp strip 8 is at its closest to the axis of the power output shaft 14 of the electric motor 13 (this will hereinafter be referred to as the rotary position of the printing drum 1 for master attachment and removal), the drive gear wheel 15 is meshed with the gear wheel 10 and thus the electric motor 13 is drivingly connected to the clamp strip 8 and can rotate it. This rotation of the lever 12, etc., is performed by a construction which comprises a solenoid 17, fixed to the frame not shown in the figures. The plunger 18 of the solenoid 17 is pivotally engaged to the end of the lever 12 remote from the pivot 11. A tension coil spring 16 biases the lever 12 in the anticlockwise direction in the figures, so as, if no actuating electrical energy is supplied to the solenoid 17, to pull said lever 12 and said electric motor 13, etc., in the anticlockwise direction in the figures to their said first position shown in FIG. 1 in which the drive gear wheel 15 is disconnected from the gear wheel 10; whereas on the other hand, if the solenoid 17 is supplied with actuating electrical energy, then it pulls the lever 12, etc., in the clockwise direction in the figures against the biasing action of the tension coil spring 16 which is overcome to their said second position shown in FIG. 2 in which the drive gear wheel 15 is meshed with the gear wheel 10. Finally, on the lever 12 there is provided an engaging bracket 19 with a slot 22 formed in a protruding end portion thereof, so arranged that, when said lever 12 and the associated parts are in their said second position shown in FIG. 2 in which the drive gear wheel 15 is meshed with the gear wheel 10, the slot 22 is accurately engaged over the hinge 7 associated with the gear wheel 10, thus holding the printing drum 1 securely in said rotary position thereof for master attachment and removal.

The solenoid device 17 and the electric motor 13 are selectively supplied with actuating electrical energy from a controller which will not be particularly described herein with regards to its structure but only in terms of its appropriate function, since these functions are periodic operations which can be performed by a controller of a per se well known type employing conventional sequence control technology, and thus various detailed structures therefore will be easily supplemented, if required, by one of ordinary skill in the relevant art.

The device described above operates as follows.

First, when an old used stencil master is to be discarded after having been used for stencil printing and the leading edge of a new stencil master is to be fixed to the printing drum 1 for a new episode of stencil printing, the device is in the position shown in FIG. 1, with the clamp strip 8 positioned in its extreme position where it is magnetically attached to the permanent magnet strip 6 with the leading edge of the stencil master S being clamped therebetween, with the driving unit 21 positioned to its upper position by the biasing action of the tension coil spring 16 with no actuating electrical energy being supplied to the solenoid device 17 so as to disengage the driving gear wheel 15 from the gear wheel 10, and with the printing drum 1 just having been positioned to its rotary for master attachment and removal as shown in the figures with said permanent magnet strip 6 and said clamp strip 8, etc., opposed to the driving unit 21. From this state, when the controller not particularly described herein so decides, next the solenoid device 17 is supplied by this controller with actuating electrical energy, so that the lever 12 is pivoted clockwise as seen in the figures against the biasing action of the tension coil spring 16 which is overcome, and thus the driving unit 21 is lowered downwards in the figures towards the printing drum 1 to the position shown in FIG. 2 in which the driving gear wheel 15 is meshed with the gear wheel 10, and the slot 22 on the bracket 19 is positively holding the hinge 7 and thus fixing the printing drum 1 in its said rotary position for master attachment and removal. Next, the electric motor 13 is appropriately supplied with actuating electrical energy, and the gear wheel 10, the pivots 9, and the clamp strip 8 fixed thereto are rotated in the anticlockwise direction as seen in the figures, so as to move said clamp strip 8 about the axis of the pivots 9 via the intermediate position shown in FIG. 2 by the solid lines to its opposite extreme position to the one described above, i.e. to its position as shown in FIG. 2 by the phantom lines in which it is attracted by the two permanent magnets 20 and is turned approximately an angle of 180° away from the permanent magnet strip 6, thus releasing the leading edge of the stencil master S. During this phase of rotating the clamp strip 8, the holding of the printing drum 1 positively in its said rotary position for master attachment and removal by the slot 22 on the bracket 19 being engaged with the hinge 7 is most helpful for ensuring that the mutual reaction between the driving gear wheel 15 and the gear wheel 10 is not able to rotate the printing drum even slightly, which might cause these gear wheels to come out of mesh with one another; this is a particular good feature of the shown preferred embodiment of the present invention. Next, the supply of actuating electrical energy to the electric motor 13 is cut off, so that the movement of the clamp strip 8 is stopped, and also the supply of actuating electrical energy to the solenoid 17 is cut off, so that the lever 12 is rotated in the anticlockwise direction in the figures and the driving unit 21 is repositioned to its upper position by the biasing action of the tension coil spring 16, and so that the driving gear wheel 15 is disengaged from the gear wheel 10, with the slot 22 on the bracket 19 now releasing the hinge 7 and thus releasing the printing drum 1 so that it is free to rotate. At this time, the printing drum is now free to rotate, and the leading edge of the stencil master S is released from being retained to the permanent magnet strip 6 of the printing drum 1. Subsequently, as the printing drum 1 is rotated, the stencil master S is removed from the drum 1; this may be done mechanically and automatically, by for example a pick off or peeling off claw, although the details are not shown herein because they are not part of the present invention.

Next, in order to fix the leading edge of a new stencil master to the printing drum 1 for a new episode of stencil printing, when the old stencil master has been disposed of and the device has been repositioned to its rotary position for master attachment and removal with the clamp strip 8 still positioned in its extreme position where it is magnetically attached to the permanent magnets 20 away from the magnet strip 6, and with the driving unit 21 positioned to its upper position by the biasing action of the tension coil spring 16 with no actuating electrical energy being supplied to the solenoid device 17 so as to disengage the driving gear wheel 15 from the gear wheel 10, then from this state, when the controller not particularly described herein so decides, next the solenoid device 17 is again supplied by this controller with actuating electrical energy, so that the lever 12 is pivoted clockwise as seen in the figures against the biasing action of the tension coil spring 16 which is overcome, and thus the driving unit 21 is again lowered downwards in the figures towards the printing drum 1 to the position shown in FIG. 2 in which the driving gear wheel 15 is meshed with the gear wheel 10, and the slot 22 on the bracket 19 is again positively holding the hinge 7 and thus fixing the printing drum 1 in its said rotary position for master attachment and removal. Next, the electric motor 13 is appropriately supplied with actuating electrical energy, this time in such a way as to operate it in the reverse rotary direction to the one used previously for removal of the stencil master, and the gear wheel 10, the pivots 9, and the clamp strip 8 fixed thereto are rotated in the clockwise direction as seen in the figures, so as to move said clamp strip 8 about the axis of the pivots 9 to the intermediate position shown in FIG. 2 by the solid lines, in which the clamp strip 8 makes an acute angle of about 45° with the magnet strip 6 and the upper surface in the figures of the stage portion 5. During this phase of rotating the clamp strip 8, the holding of the printing drum 1 positively in its said rotary position for master attachment and removal by the slot 22 on the bracket 19 being engaged with the hinge 7 is again most helpful for ensuring that the mutual reaction between the driving gear wheel 15 and the gear wheel 10 is not able to rotate the printing drum even slightly, which might cause these gear wheels to come out of mesh with one another; this is a particular good feature of the shown preferred embodiment of the present invention. Next, the electric motor 13 is deactivated, so as to stop this rotary motion of the clamp strip 8, and next the leading edge of the stencil master S is laid along the aforesaid generator of the drum 1, on top of the soft upper surface 6*a* of the permanent magnet strip 6 on the stage portion 5, by being fed theretowards; this may be done mechanically and automatically, although the details are not shown herein because they are not part of the present invention. Conveniently the leading edge of the stencil master S may be fed into this acute angle of about 45° between the clamp strip 8 and the magnet strip 2 or the top surface of the stage portion 5, and thus may be conveniently aided with being located in proper position; this is the reason for setting the clamp strip 8 to its intermediate position as explained above. This leading edge of the stencil master S is not particularly reinforced, but is just made of the same material as the remainder of the stencil master S, i.e. of a thin plastic material. When this operation is completed, the fact is detected by a sensor not shown in the figure, associated with the abovementioned sequence control device for the electric motor 13 and the solenoid device 17, and next the electric motor 13 is appropriately supplied with actuating electrical energy, again in such a way as to operate it in the reverse rotary direction to the one used previously for removal of the stencil master, and the gear wheel 10, the pivots 9, and the clamp strip 8 fixed thereto are continued to be rotated in the clockwise direction as seen in the figures, so as to move said clamp strip 8 about the axis of the pivots 9 from the intermediate position shown in FIG. 2 by the solid lines to its position as shown in FIG. 1 in which it is attracted by the permanent magnet strip 6, so that the clamp strip 8 comes to be laid on the top of the leading edge of the stencil master S, against said soft upper surface 6*a* of the permanent magnet strip 6 with the interposition of said leading edge of the stencil master S, as shown in FIG. 1, thus securely gripping the leading edge of the stencil master S between itself and said permanent magnet strip 6. Next, the supply of actuating electrical energy to the electric motor 13 is cut off, so that the movement of the clamp strip 8 is stopped, and also the supply of actuating electrical energy to the solenoid 17 is cut off, so that the lever 12 is again rotated in the anticlockwise direction in the figures and the driving unit 21 is repositioned to its upper position by the biasing action of the tension coil spring 16, and so that the driving gear wheel 15 is disengaged from the gear wheel 10, with the slot 22 on the bracket 19 now again releasing the hinge 7 and thus releasing the printing drum 1 so that it is once more free to rotate. At this time, the printing drum is now free to rotate, and the leading edge of the new stencil master S is securely retained to the peripheral line of the printing drum 1, being held between the permanent magnet strip 6 and the clamp strip 8. Subsequently, as the printing drum 1 is rotated, the stencil master S is wrapped onto the drum 1; the details of the supply of this stencil master S are not shown herein because again they are not part of the present invention. Thus, by the mutual attraction between the clamp strip 8 and the permanent magnet strip 6, they mutually clamp said leading edge of the stencil master S securely along said generator of the printing drum 1.

The clamp strip 8 is made of suitable elasticity, rigidity, thickness, and so on to be well and strongly attracted by the magnet action of the permanent magnet strip 6. And the upper surface 6*a* of the permanent magnet strip 6 is made to be soft both in order not to damage the stencil master S and in order to have a good frictional coefficient thereagainst. According to this preferred embodiment, far from any form of reinforced lug or strip being required along the leading edge of the stencil master S, it is actually best for this leading edge to be left naked and then, in order for the magnetic attraction between the clamp strip 8 and the permanent magnet strip 6 to be maximized by them being approached together as closely as possible. Thus, this system for retaining a stencil master to a printing drum is well adapted to the use of headless stencil masters which have no reinforced lug edge portions, and thus is well adapted to a rotary stencil printing device in which the stencil masters are cut off from a roll of stencil master as and when required. Further, no delicate alignment process for the stencil master is required, during use of the retaining system therefor according to the present invention. Accordingly, this preferred embodiment of the present invention is particularly well suited for use in a fully automatic stencil printing device, in which the charging and discharging of the stencil masters are both performed entirely automatically.

Although the present invention has been shown and described with reference to a preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiment, or of the drawings, but solely by the scope of the appended claims, which follow.

What is claimed is:

1. A system for retaining a leading edge of a stencil master to a cylindrical printing drum of a stencil printing device, said printing drum being mounted to be rotatable around its central axis, comprising:

a magnet strip carried by said printing drum to extend substantially along an outer surface portion thereof and parallel with said central axis;

a clamp strip made of a material which is magnetically attracted by said magnet strip, one edge of said clamp strip being hinged to said printing drum along a pivot line extending near one side of said magnet strip substantially parallel with said central axis so that said clamp strip can be pivoted for substantially 180° between a first pivot position where it lies against and along said magnet strip so as to be held thereon by an attracting magnetic force and a second pivot position where it lies against an outer surface portion of said printing drum opposite to said magnet strip with respect to said pivot line so as to be substantially free from the attracting magnetic force of said magnet strip;

a permanent magnet mounted at a circumferentially spaced surface portion of said printing drum for stably holding said clamp strip at said second pivot position; and a means for selectively driving said clamp strip between said first and second pivot positions by overcoming the holding actions applied to said clamp strip by said magnet strip and said magnet for holding said clamp strip at said second pivot position said driving means comprising:

a first gear wheel coupled to said clamp strip with its central axis in alignment with said pivot line of said clamp strip so as to be rotatable with said clamp strip around said pivot line;

a second gear wheel which can mesh with said first gear wheel to drive said first gear wheel and a means which supports said second gear wheel to be rotatable around its central axis and to be selectively movable between a first shift position where said second gear wheel meshes with said first gear wheel when said printing drum is in its certain predetermined rotational position and a second shift position where said second gear wheel is removed from said first gear wheel so as not to interfere with said first gear wheel when said printing drum is rotated around said central axis.

2. A system according to claim 1, wherein said supporting means for said second gear wheel further supports an electric motor which drives said second gear wheel.

3. A system according to claim 1, wherein said supporting means for said second gear wheel is a lever means pivotably mounted and pivoted so as to move said second gear wheel between said first and second shift positions.

4. A system according to claim 1, wherein said supporting means for said second gear wheel further incorporates a means to engage with a part integrally rotable with said printing drum so as to hold said printing drum at said predetermined rotational position when said supporting means is moved so as to move said second gear wheel to said first shift position.

5. A system according to claim 4, wherein said clamp strip is pivotably mounted by a pivot provided along said one edge of said clamp strip being rotatably supported by a tubular hinge mounted on said printing drum, and said supporting means for said second gear wheel comprises a bracket formed with a slot which is engageable with said tubular hinge when said supporting means is moved so as to bring said second gear wheel to said first shift position.

6. A system according to claim 3, wherein said supporting means for said second gear wheel is driven by a spring to be pivoted so as to move said second gear wheel to said second shift position and is driven by a solenoid against the action of said spring to be pivoted so as to move said second gear wheel to said first shift position.

* * * * *